United States Patent [19]

Born

[11] Patent Number: 4,554,931

[45] Date of Patent: Nov. 26, 1985

[54] APPARATUS FOR SEVERING ROD-SHAPED ARTICLES OF THE TOBACCO PROCESSING INDUSTRY

[75] Inventor: Siegfried Born, Geesthacht, Fed. Rep. of Germany

[73] Assignee: Hauni-Werke Körber & Co. KG, Hamburg, Fed. Rep. of Germany

[21] Appl. No.: 537,586

[22] Filed: Sep. 30, 1983

[30] Foreign Application Priority Data

Oct. 15, 1982 [DE] Fed. Rep. of Germany ..... 3238233

[51] Int. Cl.[4] ..... A24C 5/00; A24C 5/60

[52] U.S. Cl. ..... 131/84.4; 131/280; 131/94; 83/411 R

[58] Field of Search ..... 131/280, 94, 95, 84 C; 83/411 R

[56] References Cited

U.S. PATENT DOCUMENTS 3,768,353 10/1973 Milner ..... 83/411 R
3,797,338 3/1974 Molnor ..... 83/411 R
4,385,563 5/1983 Hall ..... 83/411 R

*Primary Examiner*—V. Millin
*Attorney, Agent, or Firm*—Peter K. Kontler

[57] ABSTRACT

An apparatus for severing a succession of filter rod sections, cigarettes or analogous rod-shaped articles which are transported at right angles to their respective axes and advance through a severing station has a drum-shaped conveyor which transports the articles, a rotary disc-shaped knife which is disposed at the severing station and whose peripheral cutting edge extends into a circumferential groove of the conveyor to sever successive articles at the severing station, and a stationary guide member formed with a slot for reception of those increments of the knife which are about to enter the severing station. The guide member stabilizes the knife by reducing the extent of or by eliminating vibration, fluttering and/or other stray lateral movements of those portions of the cutting edge which are about to penetrate into the oncoming articles at the severing station.

7 Claims, 2 Drawing Figures

APPARATUS FOR SEVERING ROD-SHAPED ARTICLES OF THE TOBACCO PROCESSING INDUSTRY

BACKGROUND OF THE INVENTION

The present invention relates to apparatus for severing rod-shaped articles, particularly to improvements in apparatus for severing rod-shaped articles which contain tobacco or constitute component parts of rod-shaped smokers' products. Still more particularly, the invention relates to improvements in apparatus for severing rod-shaped articles which are transported in a direction at right angles to their axes and through a severing station where the articles are divided by a circular disc-shaped knife. Typical examples of articles which can be severed in the apparatus of the present invention are plain or filter cigarettes, filter rod sections and analogous rod-shaped articles which can constitute discrete rod-shaped smokers' products or which can be combined with other types of rod-shaped articles to constitute therewith rod-shaped smokers' products.

It is well known to subdivide a continuous cigarette rod into plain cigarettes of multiple unit length (e.g., double unit length) and to thereupon subdivide each such cigarette into shorter cigarettes, e.g., into plain cigarettes of unit length. Analogously, filter rod sections are often supplied in the form of sections of multiple unit length and, somewhere along their path toward or subsequent to assembly with plain cigarettes or the like, the filter rod sections of multiple unit length are subdivided into shorter sections or plugs, e.g., into sections of unit length. Still further, presently known filter tipping machines normally assemble plain cigarettes of unit length with filter rod sections of double unit length to form filter cigarettes of double unit length. Such filter cigarettes are thereupon subdivided into filter cigarettes of unit length by severing each cigarette of double unit length midway across the filter plug of double unit length, the plug being located between and being connected to the two plain cigarettes of unit length. In each such machine, the quality of the cut is important, i.e., the cutting implement should form clean cuts which should normally extend at right angles to the axes of the severed articles. This is not always possible by resorting to presently known severing apparatus. One of the reasons for the making of unsatisfactory cuts is that the knife is likely to vibrate or perform other undesirable stray movements when it is caused to rotate at a high speed and to repeatedly penetrate into oncoming rod-shaped articles. Vibration of the knife can entail the making of unclean cuts and the formation of ragged edges along the ends of tubular wrappers for tobacco and/or filter material.

OBJECTS AND SUMMARY OF THE INVENTION

An object of the invention is to provide a novel and improved severing apparatus which can subdivide rod-shaped articles of the tobacco processing industry in such a way that the condition of the surfaces bounding a cut is more satisfactory than by resort to conventional severing apparatus.

Another object of the invention is to provide a severing apparatus which can be used with advantage in presently known cigarette rod making, filter rod making, filter tipping and analogous machines as a superior substitute for conventional severing apparatus.

An additional object of the invention is to provide a severing apparatus which ensures that the appearance of severed articles is more satisfactory than that of the articles which are severed in conventional apparatus.

Still another object of the invention is to provide a severing apparatus which ensures that the orientation of surfaces adjacent to the cuts invariably matches the optimum orientation and which can employ a conventional knife and/or a conventional conveyor for the transport of rod-shaped articles past the severing station.

An additional object of the invention is to provide an apparatus wherein the knife is effectively held against vibration and/or other stray lateral movements, at least in the region where the cutting edge of the knife penetrates into the oncoming articles.

A further object of the invention is to provide a novel and improved device for guiding the knife in the region of penetration of its cutting edge into the material of oncoming articles.

Still another object of the invention is to provide a novel and improved method of preventing stray movements of the knife in an apparatus for severing cigarettes, filter rod sections and analogous rod-shaped articles.

The invention resides in the provision of an apparatus for severing rod-shaped articles of the tobacco processing industry, such as plain cigarettes, filter rod sections, filter cigarettes and the like. The apparatus comprises a conveyor which serves to advance a succession of preferably equidistant parallel articles along a predetermined path and in a predetermined direction at right angles to the axes of the conveyed articles, and a rotary disc-shaped knife having a marginal cutting edge and being disposed in a plane extending at right angles to the axes of the conveyed articles. The cutting edge of the knife extends into the aforementioned path to sever the oncoming articles on the conveyor, and the apparatus further comprises stationary guide means for the knife. The guide means has a channel for the cutting edge. The channel is adjacent to the location of penetration of the cutting edge into the oncoming articles. Such channel is preferably disposed immediately upstream of the aforementioned location. For example, the guide means can comprise a plate-like guide member having a straight slot which constitutes the aforementioned channel.

The conveyor can comprise or constitute a rotary drum whose axis is parallel to the axis of the knife, and such drum can be provided with peripheral axially parallel flutes or analogous receiving means wherein the rod-shaped articles are or can be held by suction. The drum is preferably further provided with a circumferentially complete groove which is in register with and is located immediately past the channel, as considered in the direction of rotation of the knife, to receive a portion of the cutting edge. The guide means is preferably mounted on a stationary support which is installed in or forms part of the housing of a cigarette rod making, filter rod making or filter tipping machine.

The width of the channel preferably only slightly exceeds the thickness of the knife to thus ensure that the channel invariably eliminates or reduces the amplitude of vibrations and/or other lateral stray movements of the cutting edge during severing of successive articles.

The novel features which are considered as characteristic of the invention are set forth in particular in the appended claims. The improved severing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
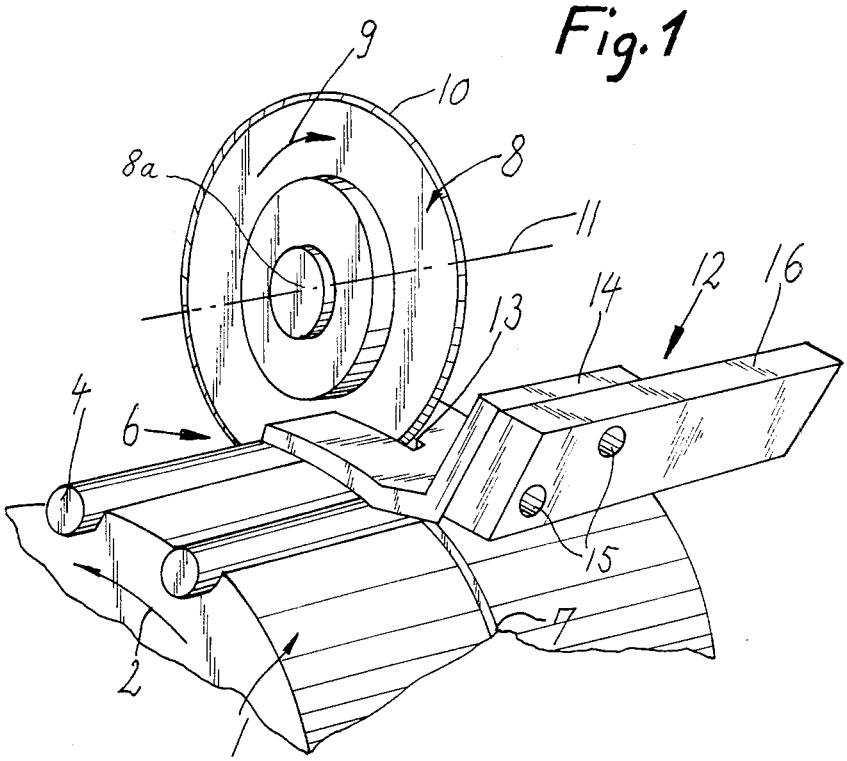
FIG. 1 is a fragmentary perspective view of a severing apparatus which embodies one form of the invention and employs a rotary drum-shaped conveyor for rod-shaped articles.
Figure 2:
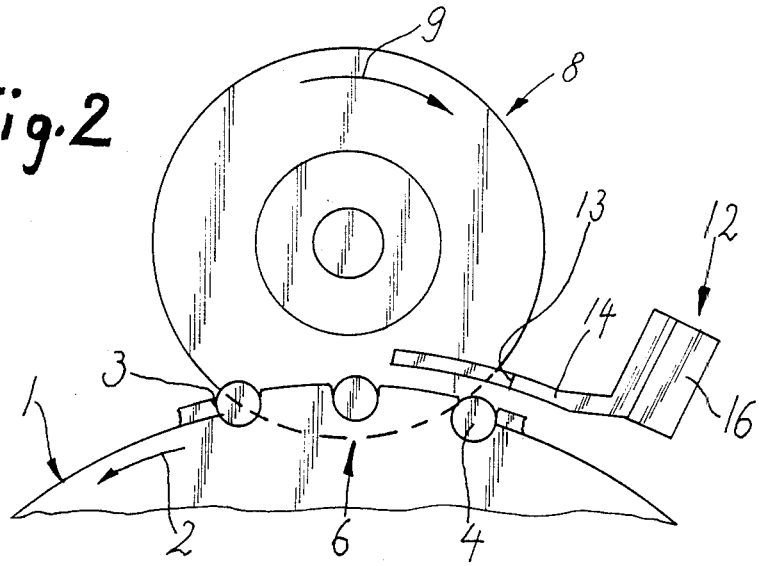
FIG. 2 is a side elevational view of the severing apparatus.

The severing apparatus which is shown in the drawing comprises a conveyor 1 in the form of a rotary drum having equidistant article receiving means in the form of axially parallel peripheral flutes 3 each of which can receive a rod-shaped article 4, e.g., a cigarette of double unit length or a filter rod section of four times unit length. When the conveyor 1 is rotated in the direction which is indicated by the arrow 2, successive articles 4 are transported sideways (i.e., at right angles to their respective axes) toward, past and beyond a severing or cutting station 6, namely, the location where the articles 4 are halved or otherwise subdivided by the endless marginal cutting edge 10 of a rotary disc-shaped knife 8. The shaft 8*a* of the knife 8 is rotatable about a horizontal axis 11 which is parallel to the axis of the conveyor 1, and the knife 8 then rotates in the direction which is indicated by the arrow 9. The periphery of the conveyor 1 is formed with an endless circumferential groove 7 which receives a portion of the knife 8 at all times and enables the knife to make a cut across the entire oncoming article 4 so that such article yields two identical halves or a longer and a shorter portion, depending upon the selected axial positions of articles 4 in their respective flutes 3. The conveyor 1 is formed with suction ports (not specifically shown) which communicate with the flutes 3 and enable the surrounding air to urge the articles 4 into the respective flutes during travel with the conveyor 1 from an article feeding conveyor upstream of the severing station 6 to an article receiving conveyor downstream of such station.

In accordance with a feature of the invention, the severing apparatus further comprises a stationary guide 12 including a substantially L-shaped guide member 14 of plate-like sheet metal or the like. One leg of the guide member 14 is adjacent to the path of movement of articles 4 toward and past the severing station 6 and is formed with an elongated channel in the form of an open slot 13 whose width only slightly exceeds the thickness of the knife 8. The surfaces bounding the slot 13 are immediately or very closely adjacent to the respective sides of the rotating knife 8, and the slot receives that portion of the cutting edge 10 which is about to penetrate into the oncoming article 4. This ensures that, if such portion of the cutting edge 10 performs vibratory and/or other stray lateral movements, the guide member 14 effectively eliminates, or reduces the amplitude of, such stray movements before the respective increments of the cutting edge 10 penetrate into the article 4 which is in the process of entering the severing station 6. The guide member 14 is permanently or detachably affixed (e.g., screwed) to a stationary support 16 which can constitute a component part of or can be installed in the frame or housing of a filter tipping, cigarette rod making or filter rod making machine. For example, the improved apparatus can be used in a cigarette rod making machine which is known as PROTOS and is manufactured and sold by the assignee of the present application. Also, the apparatus of the present invention can be used in applicant's assignee's filter tipping machines known as MAX and MAX S. The combination of elements including the support 16, the guide member 14 and the means 15 for fastening the member 14 to the support 16 is sufficiently stable to ensure that the guide member cannot vibrate or perform other stray movements with the rotating knife 8, i.e., that the extent of such stray movements is effectively reduced to a negligible value or that such stray movements are fully suppressed before the respective portions of the cutting edge 10 come into actual contact with the oncoming rod-shaped articles 4 at the severing station 6. The knife 8 is often caused to perform vibratory movements as a result of engagement with a grinding tool which is normally adjacent to the path of movement of the knife in a filter tipping, cigarette rod making or similar machine. Thus, by the simple expedient of placing the guide member 14 immediately ahead of the location (6) of penetration of the cutting edge 10 into the oncoming article 4, the cutting edge is held against stray movements to thus ensure that the quality of the cut is not affected by any stray movements, i.e., that the appearance as well as orientation of each surface which is adjacent to the cut is highly satisfactory and meets the highest standards. The surfaces bounding the slot 13 stabilize that portion of the knife 8 which is located therebetween so that fluttering, vibration and/or any other stray movement which is caused by the grinding tool and/or by other external influences cannot affect the quality of the cut.

Since the guide member 14 is immediately adjacent to and is located ahead of the severing station 6, its stabilizing influence upon the adjacent portion of the cutting edge 10 is amply sufficient to ensure that the portion of the cutting edge which is in the process of severing an article 4 does not resume vibratory, fluttering and/or other stray movement during travel through the severing station.

It is also possible to place the guide member 14 immediately downstream of the severing station 6 or to provide two guide members, one immediately upstream and the other immediately downstream of the station 6. All that counts is to ensure that the cutting edge 10 is stabilized in the region where it penetrates into and severs the oncoming article.

The guide member 14 (or an analogous guide member) can be installed in existing severing apparatus for cigarettes, filter rod sections and other rod-shaped smokers' products. Since the surfaces which bound the slot 13 do not come into actual contact with the cutting edge 10 proper, they cannot prematurely dull the cutting edge before the cutting edge begins to penetrate into the oncoming rod-shaped article. The knife 8 may be relatively rigid or readily flexible; the illustrated guide member 14 or an analogous guide member is effective even if the knife is readily flexible. Also, the thickness of the knife 8 is of no consequence, i.e., the guide member 14 or an analogous guide member can cooperate with an extremely thin or with a relatively thick knife as long as the knife exhibits the tendency to perform vibratory and/or other stray movements during travel of its cutting edge through the severing station.

The width of the slot 13 is selected with a view to ensure that the guide member 14 can eliminate, or sufficiently reduce the extent of, those stray lateral movements which would be likely to exert an adverse influence upon the appearance and/or other qualities of the cut.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for severing rod-shaped articles of the tobacco processing industry, comprising a conveyor arranged to advance the articles along a predetermined path and in a predetermined direction at right angles to the axes of the conveyed articles; a rotary disc-shaped knife having a marginal cutting edge and being disposed in a plane extending at right angles to the axes of the conveyed articles, said cutting edge extending into said path to sever the oncoming articles on said conveyor: guide means for said knife, said guide means having a channel for said cutting edge adjacent to the location of penetration of the cutting edge into the oncoming articles; and a stationary support for said guide means.

2. The apparatus of claim 1, wherein said channel is disposed immediately upstream of said location.

3. The apparatus of claim 1, wherein said guide means comprises a substantially plate-like member having a slot which constitutes said channel.

4. The apparatus of claim 1, wherein said conveyor comprises a rotary drum whose axis is parallel to the axis of said knife.

5. The apparatus of claim 4, wherein said drum has axially parallel peripheral receiving means for rod-shaped articles.

6. The apparatus of claim 4, wherein said drum has a circumferential groove in register with said channel and receiving a portion of said cutting edge.

7. The apparatus of claim 1, wherein the width of said channel only slightly exceeds the thickness of said knife.

* * * * *